United States Patent [19]

Fogel

[11] Patent Number: 5,005,825

[45] Date of Patent: Apr. 9, 1991

[54] INTEGRAL LEG BRACE AND PEDAL FOR THE HANDICAPPED

[76] Inventor: Lou Fogel, 33 Hutchinson Ct., Great Neck, N.Y. 11027

[21] Appl. No.: 65,780

[22] Filed: Jun. 24, 1987

Related U.S. Application Data

[63] Continuation-in-part of Ser. No. 926,209, Nov. 3, 1986, abandoned.

[51] Int. Cl.[5] ..... A63B 23/02

[52] U.S. Cl. ..... 272/73; 272/117; 74/594.6; 280/294

[58] Field of Search ..... 272/70, 97, 117, 67; 128/28, 25 R; 74/594.6, 594.5, 594.7; 280/294, 291, 302

[56] References Cited

U.S. PATENT DOCUMENTS

| | | | |
|---|---|---|---|
| 614,856 | 11/1898 | Gerow | 74/594.5 |
| 3,428,311 | 2/1969 | Mitchell | 272/67 |
| 3,808,910 | 5/1974 | Desbois | 74/594.6 |
| 4,402,502 | 9/1983 | Peters | 128/25 R |
| 4,451,033 | 5/1984 | Nestegard | 272/117 |
| 4,741,527 | 5/1988 | Nestegard | 272/117 |

FOREIGN PATENT DOCUMENTS

| | | | |
|---|---|---|---|
| 0719773 | 10/1930 | France | 128/28 |

*Primary Examiner*—Stephen R. Crow

[57] ABSTRACT

An integral leg brace and pedal assembly is adapted to convert a conventional pedal driven exercise machine into a machine that can be used by the handicapped. The assembly includes a specially configured footplate to which is bolted to a conventional pedal. An adjustable pole is, on one end, attached to the footplate. The axle of the pedal is threaded into an associated pedal crankarm of the machine. Straps detachably lock the lower leg in the assembly. During pedaling the free end of the pole is held whereby the upper and lower torso articulate in linked complex motion.

1 Claim, 1 Drawing Sheet

INTEGRAL LEG BRACE AND PEDAL FOR THE HANDICAPPED

This is a continuation-in-part of U.S. Ser. No. 926,209 of 11/3/86, now abandoned.

The present invention relates to a device that converts a standard "Exercycle," or similar type machine, into a pedal driven exerciser for the severely handicaped.

It is well known that handicapped people are greatly helped by mild exercise. The problem, however, lies in the fact that such persons cannot readily avail themselves of standard exercise equipement, and that without rather expensive dedicated equipement, it is difficult for them to engage in a full range of physical therapy.

Standard, portable, pedal driven exercise machines are particularly useful for sedentary, non-mobile handicaped persons, and they are relatively inexpensive. But conventional "Exercycles," and similar type machines, are usually supplied as a free-standing package consisting of moveable handlebars and seat, and thus they are, for obvious reasons, ill-suited for the severely handicapped. Other machines take a better approach. The characteristic feature of the these machines lies in the fact that a free-standing pedal driven exerciser is supplied without a seat but includes means which allows each machine temporarily to be attached to a wheelchair or standard chair. In these machines the spacing between pedal crank and wheelchair is readily changed to allow convenient operation by the handicapped person.

A more complete physical therapy routine is accomplished when the exercise machine provides for simultaneous hand and arm coordinate movement. Neither of the above-cited machines provides for this. While there are pedal driven exercisers that provide a means for such coordinate movement, and exercise of the upper body, these last-noted exercisers do not appear adapted for use by the severely handicapped.

The present invention overcomes several of the noted drawbacks associated with existing, standard pedal driven exercise apparatus and provides for a means that converts the same into an exerciser that is adpated for use by the severely handicapped. In general the inventive device comprises an integal leg brace and pedal which is detachably connected to each of the respective pedal crankarms of an existing pedal driven exercise machine. More specifically, the inventive pedal assembly includes a footplate formed with forward and rearward areas or parts. A lower leg or calf support extends upwarly from the rearward edge of the plate. A conventional pedal assembly mounts on the forward part of the plate. The pedal includes a threaded pedal axle which projects laterally or from one side of the footplate. The pedal axle threads into the pedal crankarm after the conventional pedals thereof are removed. The footplate also carries a rigid pole one end of which is pivotally connected to the plate and the other end of which is free and held during an exercise routine. The pole is, preferably, comprised of two interfitting tubes allowing adjustment of the longitudinal length of same. The pole and pedal axle are carried on and extend from, preferably, opposed lateral sides of the footplate. Means are attached to the leg support and pedal for temproarily securing the foot and lower leg in the device.

Two such inventive pedaling braces are supplied and each is, so to speak, a mirror image of the other so that each brace can be threadably atached to a respective right and left pedal crankarm of an existing machine. In this way a more or less conventional pedal driven exercise machine can be converted to a machine that can be used by the severely handicapped.

It is therefore an object of the present invention to provide a means for converting a more or less standard pedal driven exercise machine into a machine that can be used by the severely handicapped.

It is another object of the present invention to provide a leg brace adapted for use on a standard pedal driven exercise machine wherein the brace includes means for simultaneously exercising both the lower and upper part of the body.

It is a further object of the present invention to provide an integral pedal and leg brace that is adapted for use with standard pedal driven exercise machines wherein the brace is easily attached to the lower leg allowing use by the severely handicapped.

Other objects and features of the present invention will become apparent from the following detailed description considered in connection with the accompanying drawings. It is to be understood, however, that the drawings are designed for purposes of illustration only and not as a definition of the limits of the invention for which reference should be made to the appending claims.

In the drawings, wherein the same reference numeral denotes the same element throughout the several views.

Figure 1:
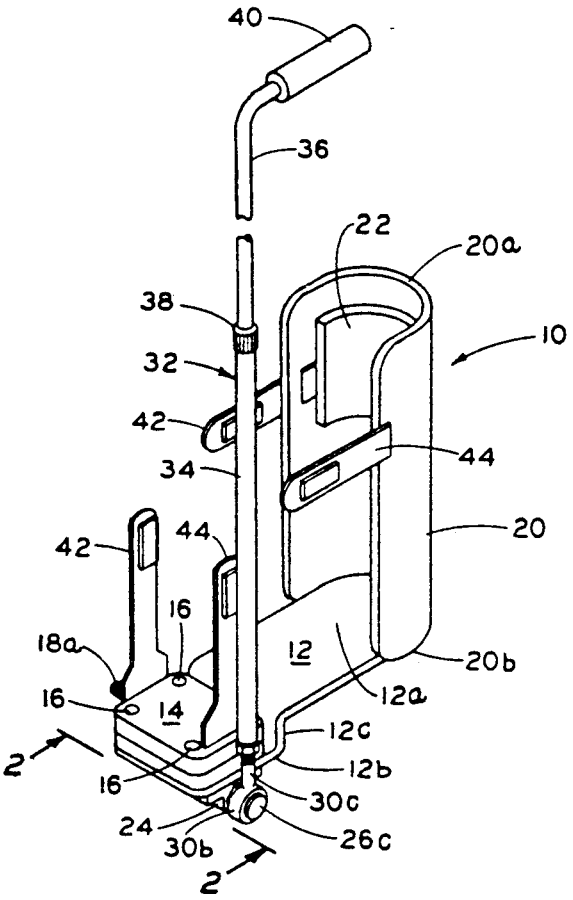
FIG. 1 is a perspective view of the inventive integral leg brace and pedal.
Figure 2:
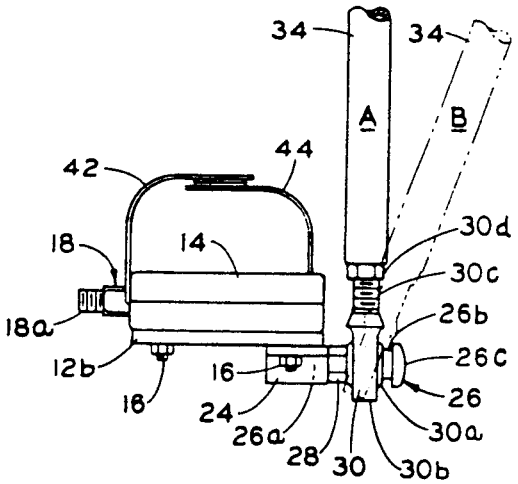
FIG. 2 is a view, in elevation, taken along the line 2—2 of FIG. 1 showing how one end of the rigid pole or arm is pivotally atached to the forward lateral side of the foot brace assembly; and, FIG. 3 is a diagrammatic perspective view showing use and operation of the inventive structure.

In detail now and refering to the drawings, FIGS. 1 and 2 show the inventive integral leg brace and pedal seen generally as reference numeral 10. The inventive structure includes a rigid footplate 12 formed of a relatively elongate rearward part or heel platform **12*a* and a forward relatively shorter pedal shelf or platform 12*b*. It will be noticed when looking at FIG. 1 that plate parts 12*a* and 12*b* are formed by opposed bends in plate 12 giving rise to a step or connecting flat 12*c*. It will be noticed, too, that rearward heel part 12*a* and pedal shelf 12*b* align along spaced parallel planes with these parts of plate 12** disposed in-line along the longitudinal axis of the plate.

A conventional pedal assembly 14 is bolted onto pedal shelf **12*b* as shown. A plurality of bolts 16 securely fasten pedal assembly 14 flush against the upper face of pedal shelf 12*b*. Pedal assembly 14 includes a journaled or rotatable threaded pedal axle 18 that, while securely fixed to assembly 14, is free to rotate about its own longitudinal axis relatively to the pedal. As is standard with such structure, pedal axle includes a leading threaded portion 18*a* with which it is threaded into a respective pedal crankarm in a manner described below. It is observed that pedal assembly 14 is bolted onto pedal shelf 12*b* in such manner as to cause axle 18 to project laterally perpendcularly from one side of the shelf while the top face of the pedal is substantially flush or aligned with the upper face of rearward plate part 12*a***.

A rigid or semi-rigid calf support 20 is, in longitudinal length, of nearly semi-cylindrical form and is defined by an upper lip 20*a* and a lower lip 20*b*. Put another way, calf support 20 is, in transverse cross-section, U-shapped or semi-circular. The outboard longitudinal rearward edge of platform part 12*a* is cut so as to conform to the inside or included peripheral face of support 20 allowing lower lip 20*b* to be attached to this last-mentioned edge. With this construction support 20 extends relatively upwardly from footplate 12 and is perpendicular thereto A calf cushion 22 is fixedly attached to the inside or included periphery of support 20. The height or longitudinal length of support 20 covers most of the rearward facing lower leg. In this manner and during use and operation of the invention, as will be explained below, support 20 nestles against and conforms to the lower part of the leg and is held firmly thereagainst.

A bracket 24 is, by means of a pair of bolts 16, fixedly attached to the underside planar face of pedal shelf 12*b*. A hub 26 is integral with or otherwise fixedly attached to bracket 24 and extends laterally therefrom. For example, in one construction hub 26 can be supplied as a discrete piece that threadably engages an associated tapped bore in bracket 24. Accordingly, one end of the hub, end 26*a*, is threaded and carries a jam or lock-nut 28. The other end of the hub is defined by a short smooth bearing area or shaft part 26*b* terminated on its free end with an enlarged end cap 26*c*.

A spherical bearing 30 is carried on shaft part 26*b*, with the latter slightly wider than the former. Spherical bearing 30 is comprised of an inner bearing 30*a* and an outer bearing collar 30*b* that is integrally formed around bearing 30*a*. This bearing construction provides for a more complicated movement than a conventional journal bearing because not only can part 30*a* revolve relatively to part 30*b* in conventional bearing manner, but one part can also pivot, so to speak, relatively to the other. Put differently, not only can collar 30*b* revolve relatively to inner bearing 30*a*, in the lateral plane of the bearing, but the collar can, while on shaft 26*b*, simultaneously pivot towards and away from bracket 24, as seen in FIG. 2. Collar 30*b* is formed integrally with a threaded stud 30*c* which extends neck-like therefrom.

When end 26*a* is threaded into its complementary bore in bracket 24, nut 28 is tightened against the confronting face of bracket 24 locking hub 26 and collar 30 to the bracket.

An adjustable rigid pole 32 is comprised of two, rigid, interfitting rods or tubes 34 and 36. One end of tube 34 threadably engages stud 30*c* projecting from bearing collar 30*b*, as shown. A jam nut 30*d* locks this last-mentioned end of the tube to the stud and hence this end of tube 34 is held on hub 26 yet can revolve thereabout. One end of rod or tube 36 is slidably received in the free and complementary sized open end of tube 34. The two tubes are held in rigid interfitting engagement by means of a threaded friction collar 38. The other and free end of tube or rod 36 is bent and carries a hand-grip 40.

Means are carried on both leg support 20 and in the region of pedal 14 for, respectively, temporarily securing the lower leg and foot in the inventive apparatus. Such means might comprise complementary Velcro® straps 42 and 44. A multitude of arrangements can be employed, here, for this purpose such as buckels, snaps, elastic members, and the like.

Of course it will be apparent that, as noted above, the inventive structure will be supplied as a pair, one for the "rightside" and one for the "leftside" pedal crankarms. This is to say that while the two pedal assemblies of the present invention are similar, they are necessarily mirror images of each other whereby each one fits onto an associated pedal crankarm.

Figure 3:
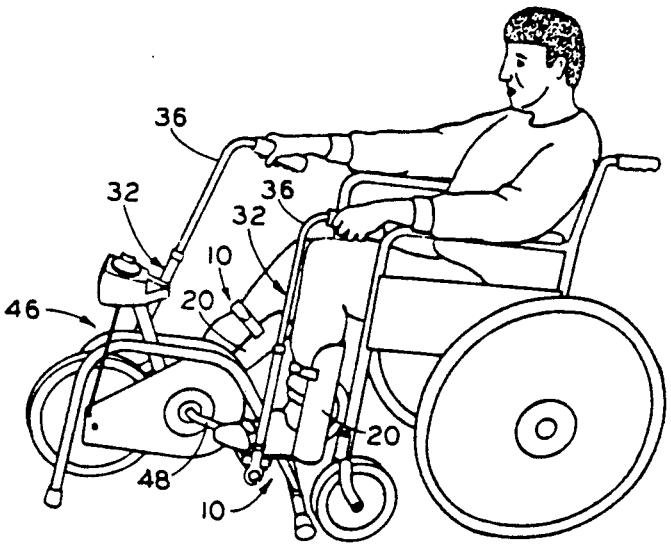

Use and operation of the inventive apparatus is straight-forward and understood best with reference to fig. 3. The "rightside" and "leftside" pedals of a conventional pedal driven exerciser 46 are removed. Hub 18*a*, associated with each "rightside" and "leftside" one of inventive devices 10, is threaded into an associated threaded bore on respective pedal crankarms 48. The person's foot is placed on a respective right and left footplate 12 of associated devices 10. The lower leg and foot are then detachably C secured in apparatus 10 by interengaging Velcro® straps 42 and 44 as they are brought up tight. This causes support 20 and chushion 22 to nestle firmly against the lower leg or calf, helping to support the same, while the toe portion of the foot becomes fastened on pedal 14. Hand gips 40 are grasped and the user begins to pedal as if on a bicycle. As devices 10 are pedaled, axles 18 move in circular orbit around the center support of the pedal crankarms. This motion is imparted to respective footplates 12 as the footplates freely rotate relatively to an associated axle 18. The lower ends of tubes 34 that are affixed to respective collar bearings 30 follow movement of the orbit of hubs 26, but because the upper ends of poles 32, or more precisely, rods 36, are free and held by the user, these upper ends take a more or less elliptical orbit in free space. Since shaft part or journal 26*b* is somewhat wider than the width of bearing 30*a*, this facilitates or accomodates the displacement of rspective poles 32 between positions 'A' and 'B,' as seen in FIG. 2, while the shaft simultaneously moves in the above-noted circular orbit.

With this construction the upper and lower torso of the user move in complex motion driven by seperate but linked articulation. This results in a more complete form of exercise that is of great benefit to the user. For those who have difficulty moving the lower part of the body, poles 32 can be used to initiate pedaling allowing a cojoint operation between pedaling, and pushing with the arms.

When the exercise routine is completed, the user merely uncouples means 42 and 44, and disengages from apparatus 10.

There are a variety of materials from which the components of apparatus 10 can be made. Certain high stressed parts can be made of metal and these parts might include axle 18, bracket 24, spherical bearing 30 and hub 26. Other parts can be made of plastic, fiberglass, nylon, and the like. The material chosen, to a large degree, is merely a matter of design choice. Indeed, the entire inventive apparatus can be made from plastic or nylon, or both.

While only one embodiment of the present invention has been shown an described, it is to be understood thay many changes and modifications can be made hereto without departing from the spirit and scope hereof.

What is claimed is:

1. An integral leg brace and pedal apparatus adapted to convert a standard pedal driven exercise machine into a machine that can be used by the handicapped comprising an elongate pedal plate formed of a forward pedal shelf and a rearward heel platform, said plate having a step-like bend adapted to place the shelf and heel platform on spaced parallel planes with the pedal shelf disposed relatively below the heel platform, a pedal including a threaded pedal axle, said pedal fixedly attached to the pedal shelf with the pedal axle thereof extending laterally from one side of the pedal shelf and adapted to engage a respective pedal crankarm of the machine, a calf support of essentially semi-cylindrical configuration, said calf support extending relatively upwardly from the rearward edge of the heel platform, and strap means carried on the calf support for holding the lower leg within said calf support semi-cylindrical configuration such that as the lower torso is exercised, the lower leg remains within said configuration, a hub fixedly attached to and extending laterally from the pedal shelf, said hub being placed on the pedal shelf so as to be at a location that is substantially opposed to said axle, a spherical bearing attached to said hub for rotation therewith, a pair of rigid poles, each on one end being attached to said bearing for cojoint rotation therewith, and the other end of said pole being accessible to the exerciser, whereby simultaneous use of said pedals and said poles contributes to linked complex articulation of the upper and lower torso.

* * * * *